US006106134A

United States Patent [19]

Bomas

[11] Patent Number: 6,106,134

[45] Date of Patent: Aug. 22, 2000

[54] ADJUSTABLE AZIMUTH LIGHTING WELL LIGHT

[76] Inventor: Bert G Bomas, 2895 Hwy. 49 W., Ashland, Tenn. 37015

[21] Appl. No.: 09/187,783

[22] Filed: Nov. 7, 1998

[51] Int. Cl.[7] ..... F21V 21/26

[52] U.S. Cl. ..... 362/153.1; 362/153; 362/372; 362/418; 362/427; 362/428

[58] Field of Search ..... 362/153, 153.1, 362/372, 374, 375, 368, 370, 371, 418, 427, 428, 433

[56] References Cited

U.S. PATENT DOCUMENTS

| | | | |
|---|---|---|---|
| 484,964 | 10/1892 | Hills | 362/426 |
| 1,669,882 | 5/1928 | Sperry | 362/426 |
| 5,183,330 | 2/1993 | Rishel et al. | 362/372 |
| 5,230,559 | 7/1993 | Porter et al. | 362/153.1 |
| 5,481,443 | 1/1996 | Wagner et al. | 362/153.1 |
| 5,887,966 | 3/1999 | Eissner et al. | 362/153.1 |

*Primary Examiner*—Sandra O'Shea
*Assistant Examiner*—Ismael Negron
*Attorney, Agent, or Firm*—Michael I Kroll

[57] ABSTRACT

A well light for illuminating an object. The well light includes a cylindrical housing having an open top side with a diagonal slant. Alternatively, the top side may extend parallel to the bottom side and the flat surface on which it is placed. A light bulb is positioned within the housing for projecting light produced thereby through the open top side and a pivoting device is connected to the light bulb for pivoting the light bulb and changing the angle of projection of light produced and thereby illuminating the desired object to a desired intensity level. The pivoting device includes a knob positioned on an outer side of the housing, a ring extending around a top side of the light bulb and a device for connecting the knob to the ring whereby when the knob is turned, the ring and light bulb are also caused to turn. A cover is also releasably connected to the top side of the housing and may be of any desired color to thereby tint the light produced by the light bulb. Alternatively, the light bulb may be able to produce any desired color of light to provide a desired effect on the object illuminated.

18 Claims, 10 Drawing Sheets

ADJUSTABLE AZIMUTH LIGHTING WELL LIGHT

BACKGROUND OF THE INVENTION

1. Field of the Invention

The present invention relates generally to lighting fixtures and, more specifically, to an illumination device providing maintenance free lighting to a desired area, the direction of projection and tint of the light beam produced by the device being adjustable.

2. Description of the Prior Art

Numerous types of illumination devices designed to provide outdoor lighting have been provided in the prior art. For example, U.S. Pat. Nos. 5,055,987; 5,134,550; 5,678,920; 5,681,105; 5,779,349 and 5,785,410 all are illustrative of such prior art. While these units may be suitable for the particular purpose to which they address, they would not be as suitable for the purposes of the present invention as heretofore described.

U.S. Pat. No. 5,055,987

Inventor: Ellson et al.

Issued: Oct. 8, 1991

A light fixture adjustable in focus and/ or beam direction. Light fixture is of the "vertical" or "downlighting" type, and preferably includes a bulb/lens assembly mounted atop a relatively short post. Bulb/lens assembly includes a lens which rotatably carries a cap. Inside lens and beneath cap is a bulb and a reflector assembly. Reflector assembly includes a reflector holder having a plurality of outwardly-extending posts which are first received y vertical slots in lens and finally by cam grooves in cap. Rotation of cap relative to lens causes cam groove to act upon posts to move reflector assembly relative to bulb to adjust the width or focus of the light beam; and/or tilted vis-a-vis bulb to adjust the direction of the light beam.

U.S. Pat. No. 5,134,550

Inventor: Richard A. Young

Issued: Jul. 28, 1992

An area lighting fixture is constructed having a tubular pole member having a reflective interior surface and a light source mounted inside the pole and at a lower end thereof. A reflective, concave member is positioned below the light source and generally collimates light from the light source upward through the pole. An access opening covered by an access panel permits convenient access to the light source in the instance where the source fails. At the upper end of the pole, a light dispersing cap having a generally convex reflector receives the light from the source and disperses it around the pole.

U.S. Pat. No. 5,678,920

Inventor: Glenn Harvey Kerr

Issued: Oct. 21, 1997

A brick device which has a hollow simulated brick portion with a light emitting upper surface portion, and an electric bulb unit supported within the simulated brick portion whereby, in use, light is transmitted through said upper surface. The upper surface portion may be a sheet of transparent material supported on ledges and snugly-fitting within the brick portion. The base of the brick portion is open over a substantial part of its area to facilitate drainage and substantially reduce condensation.

U.S. Pat. No. 5,681,105

Inventor: Larry J. Nau

Issued: Oct. 28, 1997

A lamp in the shape of a brick and adapted for placement between bricks in a driveway or on roads, having an outer case, an electric bulb housing mounted in the case, a bulb socket supported on the bulb housing mounted in the case, and a translucent lens formed of a high strength plastic mounted on the top of the bulb housing. In a preferred embodiment the unit comprised of the bulb housing and lens is removable mounted in the case by means of lathing members. Resilient blocks receiving the lower ends of the screws to lock such unit to the case and is removable for replacing a bulb in the bulb socket or for cleaning the interior of the case. The screws in combination with the resilient blocks permit expansion and contraction of the bulb housing-lens unit while in locked position. For installation between bricks, e.g. in a driveway, the lamp is inserted between adjacent bricks and held in place by mortar.

U.S. Pat. No. 5,785,410

Inventor: Michael Del Branson, Sr.

Issued: Jul. 28, 1998

An electronic road beacon is provided with a flashing light. The beacon functions as a traffic alert device by being placed on the surface of a roadway or other surface. Accordingly, the beacon is designed to withstand the impact of a car, truck or other vehicle which may strike or run over the beacon. The beacon comprises three essential components. The first is a circular base plate having a raised annulus around the periphery which defines an interior opening and a bottom portion. The second component is a dome comprising a spherical lens having internal concentric radial freznel and at least one reflector mirror. The dome is mounted to the base plate and defines a sealed interior space that is protected from weather and other harmful conditions. The third component is a circuit board that is mounted to the bottom portion of the base plate in the interior space of the beacon. The circuit board contains solid state circuitry and a light emitting bulb. The light is focused and intensified by the dome. In addition, a magnetic on/off switch is activated by a magnetic key to operate the bulb.

U.S. Pat. No. 5,779,349

Inventor: Gary L. Reinert, Sr.

Issued: Jul. 14, 1998

An airport inset light adjustable alignment container set provides a light fixture and support for airport runway, taxiway, or other aircraft ground traffic areas and variable length extension means for rotatably adjusting height by a vertical displacement range of up to six inches (15 cm) or more. For previously installed, old airport inset lights, a variable length extension assembly of the present invention can be connected to a fixed connecting flange for rotatably adjusting the height and azimuth alignment of a conventional, prior art airport inset light, e.g., one which has been previously installed without the benefit of the present invention. A novel top flange is adapted to receive various different designs of inset lights and to provide a protection ring "mud dam". Rotation locking means are provided for securing the rotatable adjustment apparatus from further rotation.

SUMMARY OF THE PRESENT INVENTION

The present invention relates generally to lighting fixtures and, more specifically, to an illumination device providing maintenance free lighting to a desired area, the direction of projection and tint of the light beam produced by the device being adjustable.

A primary object of the present invention is to provide an outdoor durable well light that will overcome the shortcomings of prior art devices.

Another object of the present invention is to provide an outdoor durable well light which is able to provide adequate lighting to a desired area.

A further object of the present invention is to provide an outdoor durable well light including easily manipulated controls for adjusting the azimuth of the light beam produced and thereby controlling the illumination of the desired area.

A yet further object of the present invention is to provide an outdoor durable well light wherein a lens cover of any desired color may be positioned to cover the light beam produced and thereby control the color tint of the produced light.

A still further object of the present invention is to provide an outdoor durable well light able to highlight desired areas of a landscape.

An even further object of the present invention is to provide an outdoor durable well light having a top side extending parallel to the ground and having a height such that when positioned on a lawn a lawnmower is able to pass thereover without being obstructed.

Another object of the present invention is to provide an outdoor durable well light that is simple and easy to use.

A still further object of the present invention is to provide an outdoor durable well light that is economical in cost to manufacture.

Additional objects of the present invention will appear as the description proceeds.

A well light for illuminating an object is disclosed by the present invention. The well light includes a cylindrical housing having an open top side with a diagonal slant. Alternatively, the top side may extend parallel to the bottom side and the flat surface on which it is placed. A light bulb is positioned within the housing for projecting light produced thereby through the open top side and a pivoting device is connected to the light bulb for pivoting the light bulb and changing the angle of projection of light produced and thereby illuminating the desired object to a desired intensity level. The pivoting device includes a knob positioned on an outer side of the housing, a ring extending around a top side of the light bulb and a device for connecting the knob to the ring whereby when the knob is turned, the ring and light bulb are also caused to turn. A cover is also releasably connected to the top side of the housing and may be of any desired color to thereby tint the light produced by the light bulb. Alternatively, the light bulb may be able to produce any desired color of light to provide a desired effect on the object illuminated To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
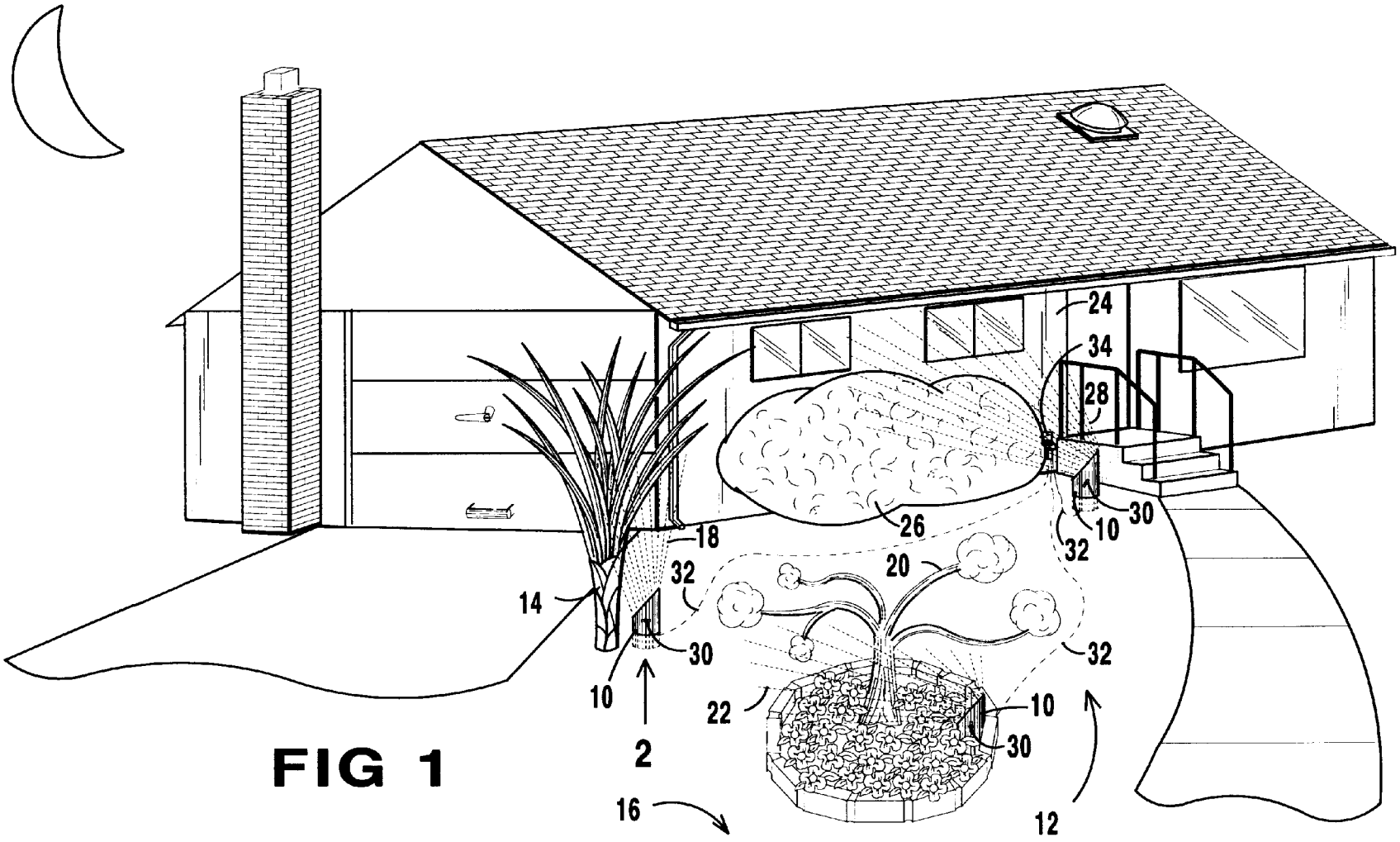
FIG. 1 is a perspective view of an outdoor area being illuminated by the outdoor durable well light of the present invention.

Turning now descriptively to the drawings, in which similar reference characters denote similar elements throughout the several views, the Figures illustrate the outdoor durable well light of the present invention. With regard to the reference numerals used, the following numbering is used throughout the various drawing figures.

10 outdoor durable well light of the present invention
12 landscape to be lit by well lights
14 tall tree being illuminated
16 ground
18 dashed lines representing first angle of projection of light
20 short tree being illuminated
22 dashed lines representing second angle of projection of light
24 side of house being illuminated
26 bush adjacent to side of house being illuminated
28 dashed lines representing third angle of projection of light
30 adjustment device
32 power cord
electrical power supply
36 cylindrical housing
38 flat bottom side
40 diagonal top side
42 cover positioned over top side
44 securing pins connecting cover to top side
46 light
48 power cord
50 side wall of cylindrical housing
52 knob
54 arrow indicating direction of pivoting of knob
56 arrow indicating direction of pivoting of light
58 clip
60 ring of light
61 skirt depending from the ring
62 screw connecting knob to clip
64 first washer
66 first side of skirt
68 second side of skirt
70 second washer
72 third washer
74 recesses in top side of cover
76 recesses in top side of cylindrical housing
78 top side of securing pin
80 first prong of securing pin
82 second prong of securing pin
84 first recess in skirt
86 second recess in skirt
88 base of light
90 first connector on base of light
92 second connector on base of light
94 well light including the flat top side
96 flat top side o f well light

DETAILED DESCRIPTION OF THE PREFERRED EMBODIMENT

Turning now descriptively to the drawings, in which similar reference characters denote similar elements throughout the several views, FIGS. 1 through 10 illustrate the outdoor durable well light of the present invention indicated generally by the numeral 10.

The outdoor durable well light 10 is illustrated in FIG. 1. A number of well lights 10 are positioned all about the landscape 12 of a property, each highlighting a particular desired areas of the landscape 12. A first one of the well lights 10 is positioned to highlight a tall tree 14. In order to highlight the tall tree 14, the well light 10 is projecting the light produced thereby at a first angle slightly less than perpendicular to the ground 16 as indicated by the dashed lines labeled with the numeral 18. A second one of the well lights 10 is positioned to highlight a small, short tree 20. In order to highlight the small, short tree 20, the well light 10 is projecting the light produced thereby at a second angle almost parallel to the ground 16 as indicated by the dashed lines labeled with the numeral 22. A third one of the well lights 10 is positioned to highlight a side of the house 24 and a bush 26 positioned adjacent thereto. In order to highlight the side of the house 24 and the bush 26, the well light 10 is projecting the light produced thereby at a third angle somewhere between the first and second angles of the first and second well lights as indicated by the dashed lines labeled with the numeral 28. In order to adjust the angle at which the light is projected, each of the well lights 10 include an adjustment device 30 positioned on a side thereof. The well lights 10 are each also provided with a power cord 32 for connection to an electrical power supply 34.

Figure 2:
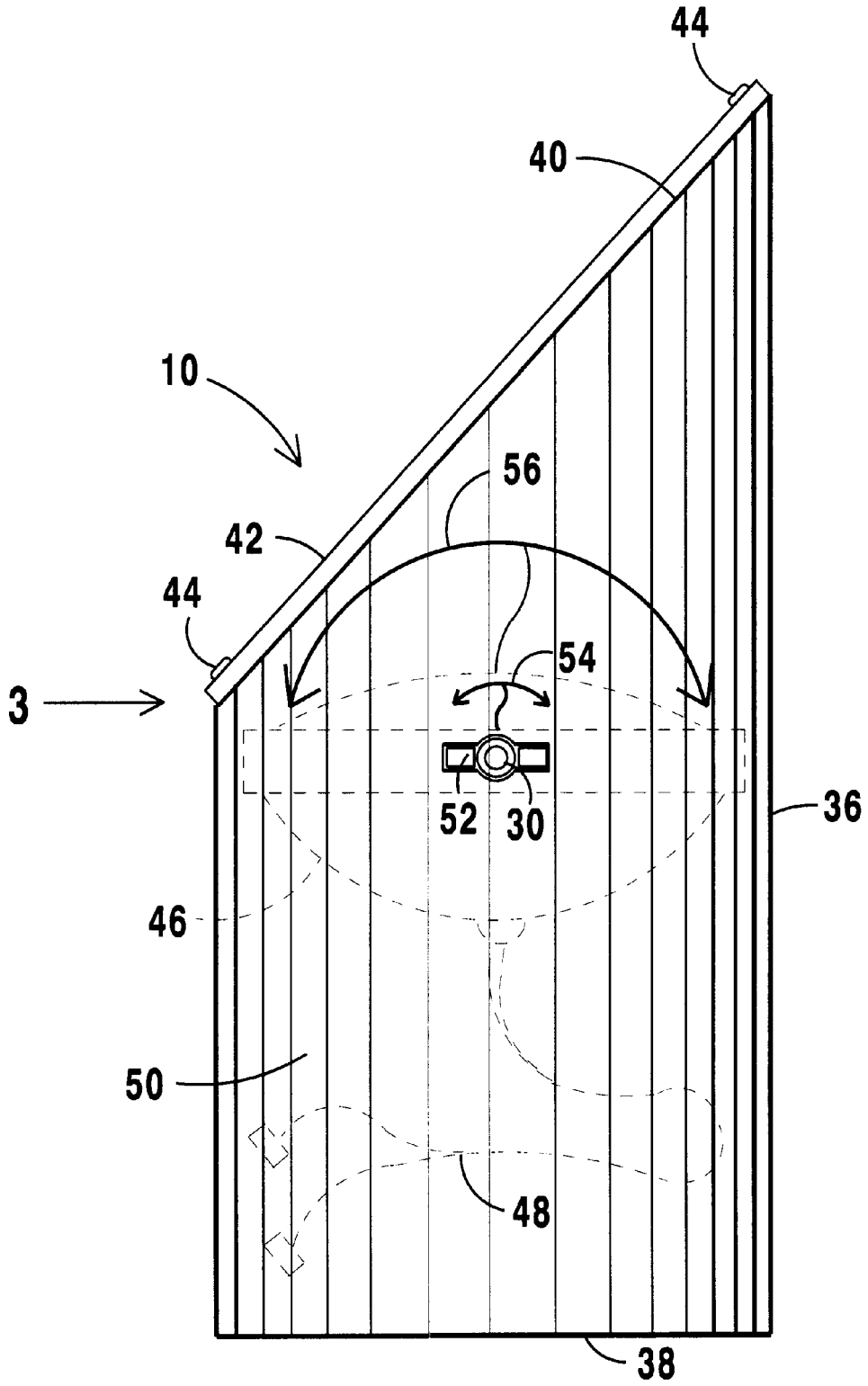
FIG. 2 is a side view of the outdoor durable well light of the present invention.

A side view of the well light 10 is illustrated in FIG. 2 with the internal components shown in dashed lines. As can be seen from this figure, the well light 10 includes a cylindrical housing 36 having a flat bottom side 38 for positioning the well light 10 on the ground 16 and a diagonal top side 40. A lens cover 42 is removably connected to the top side 40 by securing pins 44. A light 46 is pivotally connected within the cylindrical housing 36 and includes a power cord 48 extending therefrom for connection to an electrical supply. The light 46 is substantially cylindrical in shape and has a circumference slightly less than an inner diameter of the housing 36. The adjusting device 30 extends through a side wall 50 of the cylindrical housing 36 for connecting with the light 46. The adjusting device 30 includes a knob 52 which may be pivoted about a central axis extending therethrough as indicated by the arrow labeled 54. As the light 46 is pivotally connected to the cylindrical housing 36 and connected to the adjusting device 30, it is caused to pivot with the knob 52 as indicated by the arrow labeled 56.

Figure 3:
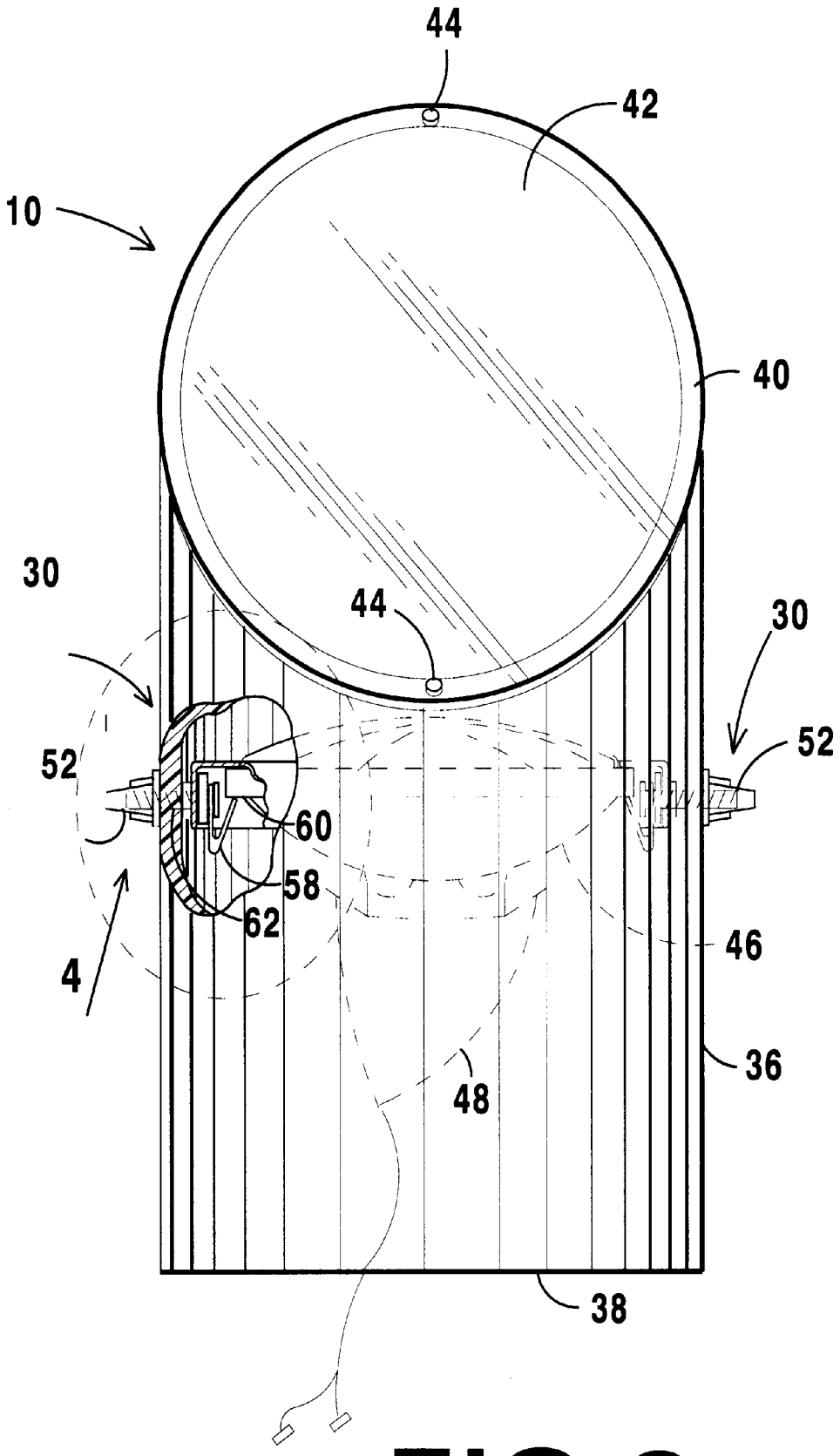
FIG. 3 is a front view with parts cut away of the outdoor durable well light of the present invention.

A front view of the well light 10 is illustrated in FIG. 3. Again the elements contained within the cylindrical housing 36 are illustrated in dashed lines. A portion of the cylindrical housing 36 is cut away to illustrate the adjusting device 30 and its connection to the light 46. The adjusting device 30 includes knobs 52 on opposing sides of the cylindrical housing 36. Each of the knobs 52 extend through the cylindrical housing 36 and connect with the light 46. A ring 60 is positioned over the light 46 and extends past the edge of the light 46. A clip 58 is connected on either side of the ring 60 and a screw 62 extends through each respective clip 58 engaging a respective one of the knobs 52. Thus, when either or both of the knobs 52 are turned, the screws 62 are also caused to turn. The turning of the screws 62 cause the clips 58 and thus the ring 60 to pivot. As the ring 60 pivots, the light 46 is also caused to pivot. The pivoting of the light 46 causes the angle at which light is projected therefrom to change thus affect the lighting of the landscape 12. The direction of the projected light is thus adjusted to highlight a desired item or area as illustrated in FIG. 1.

The light 46 is set within the ring 60 and held by the clips 58 which are attached to the skirt 61 of the ring 60 by respective screws 62 which extend through the exterior wall of the housing 36 and are engaged by respective ones of the knobs 52. The clips 58 release the light 46 from its secured position when the screw s 62 are released in order to replace the light 46.

Figure 4:
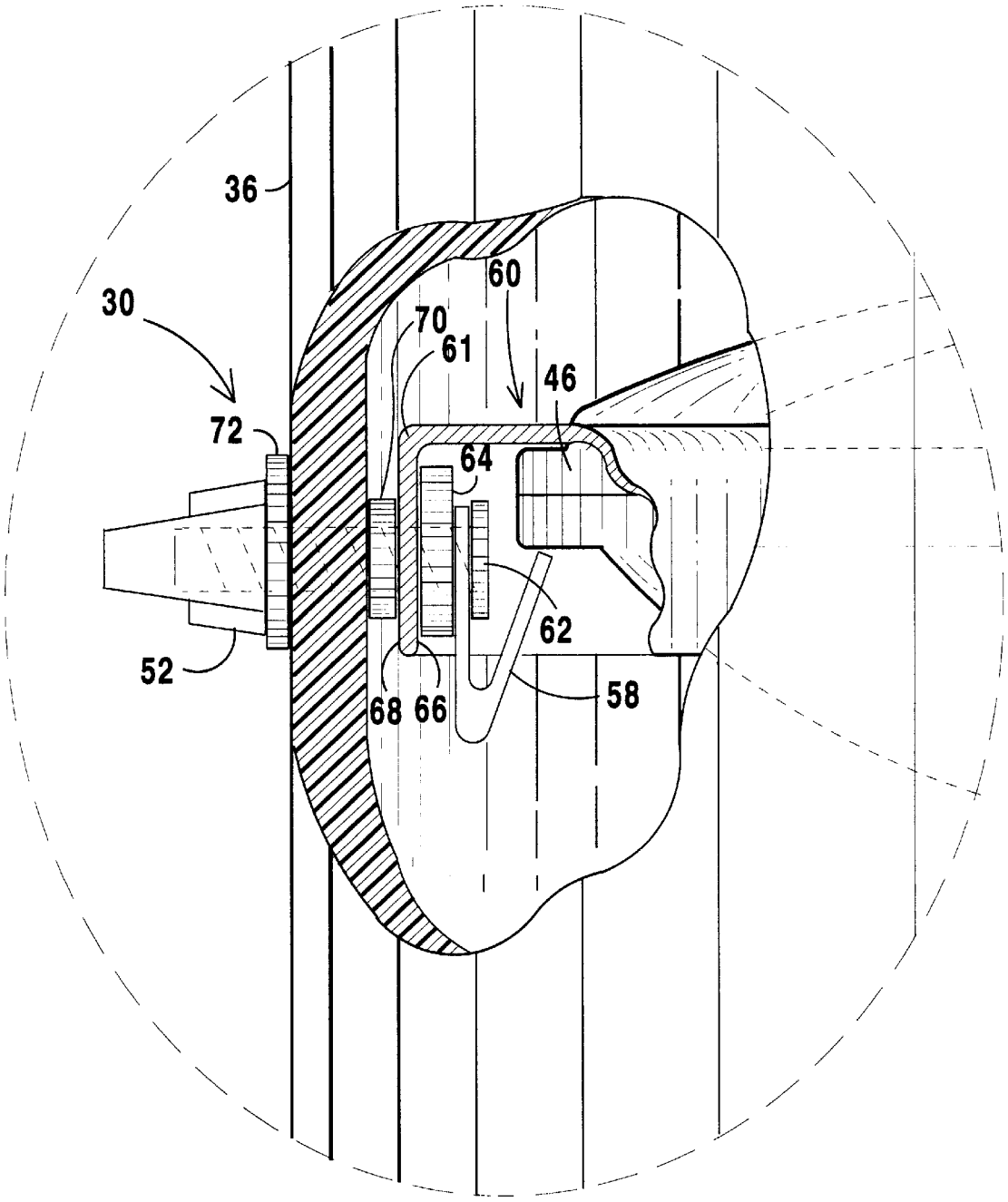
FIG. 4 is a enlarged view of a turning mechanism of the outdoor durable well light of the present invention taken from within the circle labeled 4 of FIG. 3.

An enlarged view of the adjusting device is illustrated in FIG. 4. This view is taken from within the circle labeled 4 of FIG. 3. As can be seen from this figure, the screw 62 extends through the clip 58, the side wall of the cylindrical housing 36 and into the knob 52 thus connecting the clip 58 to the knob 52. The ring 60 extends past the edge of the light 46 and includes a skirt 61 depending therefrom forming pool surrounding the light 46. A first washer 64 is preferably positioned between the clip 58 and a first side 66 of the skirt 61, a second washer 70 is preferably positioned between a second side 68 of the skirt 61 and the inner side of the cylindrical housing 36 and a third washer 72 is preferably positioned between the outer side of the cylindrical housing 36 and the knob 52. The screw 62 extends through each of the washers 64, 70 and 72. The first, second and third washers 64, 70 and 72 are provided to aid the pivoting of the adjusting device 30 and thus the light 46. Thus, when the knob 52 is turned the light 46 is caused to pivot therewith due to the common connection to the screw 62.

Figure 5:
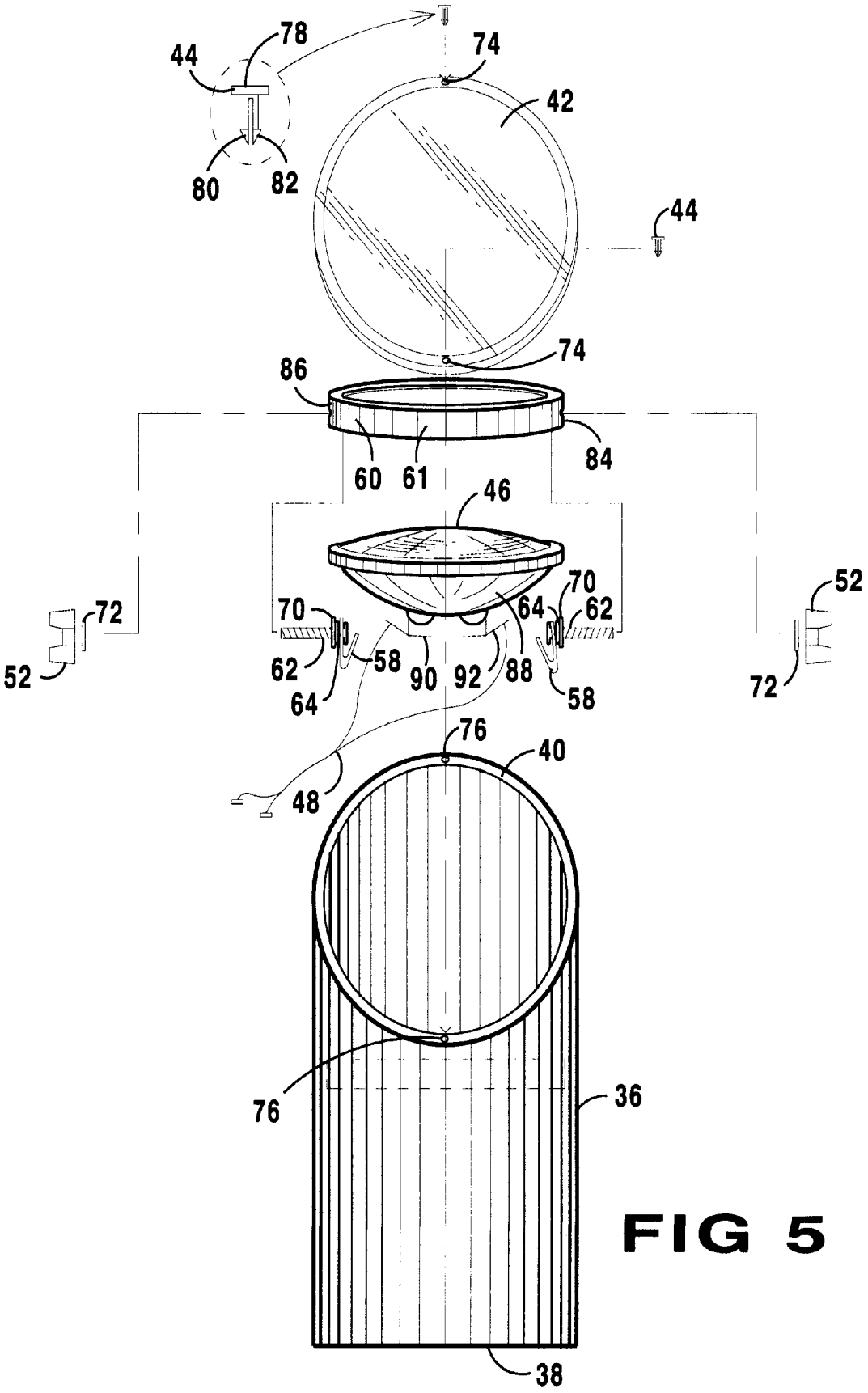
FIG. 5 is a front exploded view of the outdoor durable well light of the present invention.

An exploded view of the well light 10 is illustrated in FIG. 5. As can be seen from this figure, the cylindrical housing 36 is hollow and includes a flat bottom side 38 and a slanted or diagonal top side 40. Recesses 74 extend through the cover 42 and matching recesses 76 extend into the top side 40 for receiving the securing pins 44 for releasably securing the cover 42 to the cylindrical housing 36. The securing pins 44 include a top side 78 having a circumference larger than the circumference of the recesses 74 in the cover 42 and the recesses 76 in the top side 40 and first and second prongs 80 and 82 extending therefrom. The first and second prongs 80 and 82 are separated by a distance and act to move together when a pressure is applied inserting the first and second prongs 80 and 82 into a respective recess 74.

The light 46 is shaped to substantially match the shape of the inside of the housing 36 and the ring 60 has a shape substantially similar to the shape of the light 46. The circumference of light is smaller than the circumference of the inner side of the housing 36. The circumference of the ring 60 is larger than the circumference of the light 46 and thus the ring extends past the edge of the light 46 when positioned thereon but smaller than the circumference of the inner side of the housing 36. The skirt 61 depends from the ring 60 and forms a pool between the inner side 66 of the skirt 61 and the light 46. Extending through the skirt 61 are first and second recesses 84 and 86 for receiving the screw 62 therethrough. The clip 58, first washer 64 and second washer 70 are aligned and positioned within the pool with a respective screw 62 extending therethrough. The screws 62 will extend through recesses in the housing 36 and engage a respective third washer 72 and knob 52 on an outer side of the housing 36.

Extending from a base 88 of the light 46 are first and second electrical connectors 90 and 92 for connection to the electrical cord 48. The electrical cord 48 will supply electricity to the first and second electrical connectors 90 and 92 and thereby cause the light to illuminate when connected to a power supply.

Figure 6A:
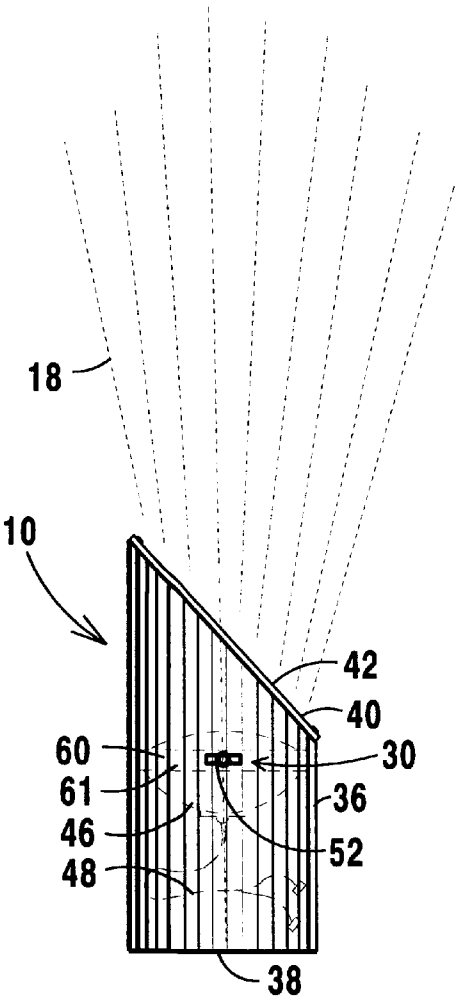
FIG. 6A is a side view of the outdoor durable well light of the present invention directing light in a first direction.
Figure 6B:
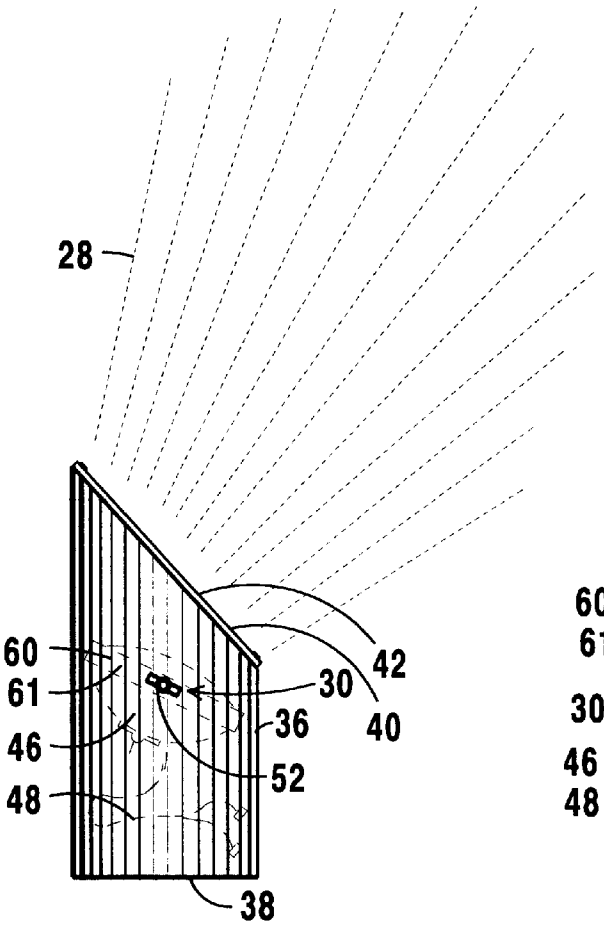
FIG. 6B is a side view of the outdoor durable well light of the present invention directing light in a second direction.
Figure 6C:
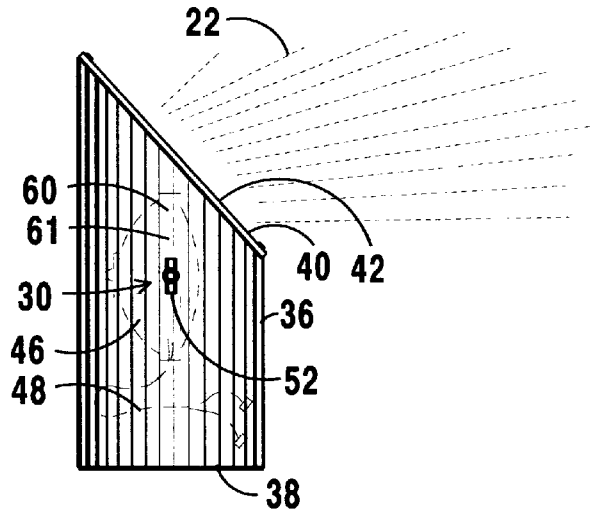
FIG. 6C is a side view of the outdoor durable well light of the present invention directing light in a third direction.

FIGS. 6A, 6B and 6C illustrate the well light 10 projecting light produced thereby at different angles. In FIG. 6A the light 46 is positioned to be substantially parallel to the ground or bottom side 38 of the housing 36. This causes the light produced thereby to be directed straight up, substantially perpendicular to the ground. The projection of the light is similar to the light illuminating the tall tree 14 of FIG. 1. In FIG. 6B the light 46 is positioned to be directed at a substantially 45° angle to the ground or bottom side 38 of the housing 36. This causes the light produced thereby to be directed at an angle towards the object to be illuminated. The projection of the light is similar to the light illuminating the side of the house 24 and adjacent bush 26 of FIG. 1. In FIG. 6C the light 46 is positioned to be substantially perpendicular to the ground or bottom side 38 of the housing 36. This causes the light produced thereby to be directed substantially parallel to the ground. The projection of the light is similar to the light illuminating the short tree 20 of FIG. 1. The angles of projection shown are for purposes of example only. The light may be pivoted to project light at any angle between parallel to the ground and perpendicular to the ground.

Figure 7C:
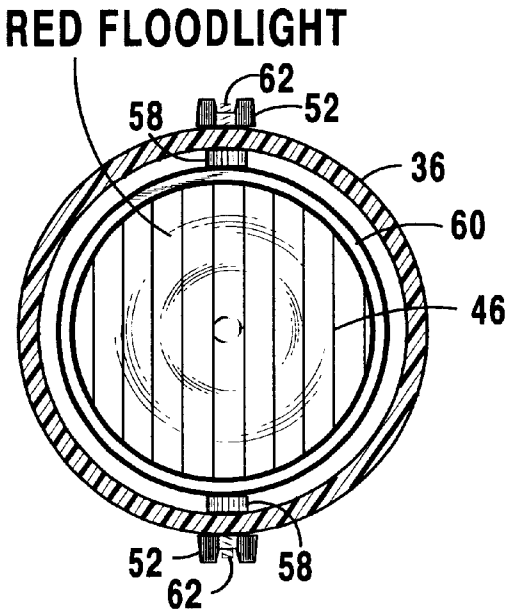
FIG. 7C is a top view of the outdoor durable well light of the present invention providing illumination of a third, red, color.
Figure 7B:
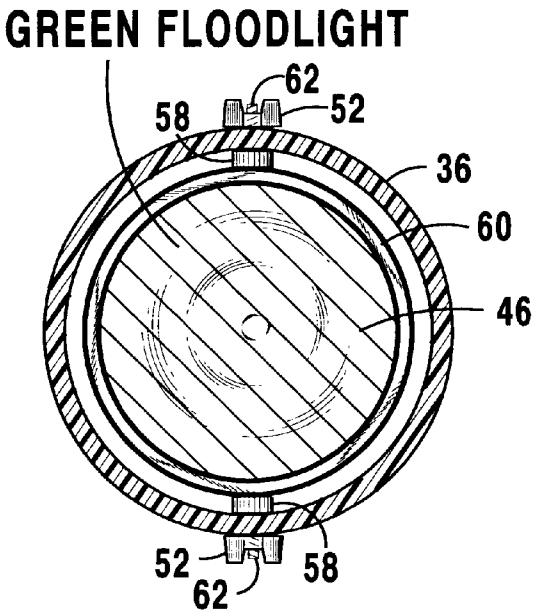
FIG. 7B is a top view of the outdoor durable well light of the present invention providing illumination of a second, green, color.
Figure 7A:
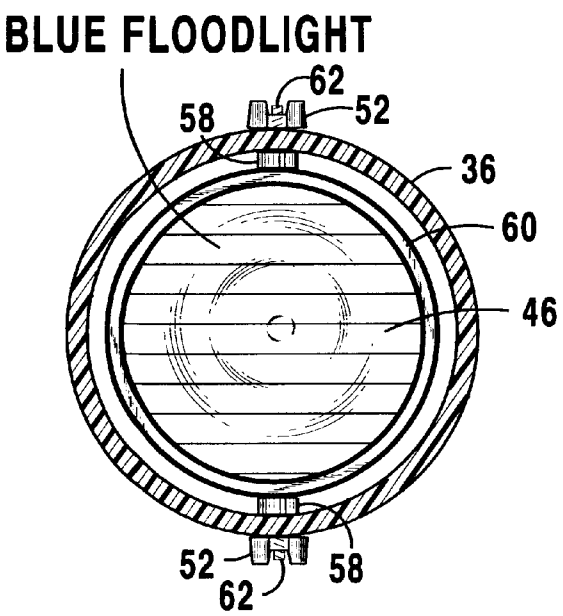
FIG. 7A is a top view of the outdoor durable well light of the present invention providing illumination of a first, blue, color.

FIGS. 7A, 7B and 7C illustrate the use of different colored lights to thereby change the tint of the produced light to a desired color. FIG. 7A illustrates use of a blue colored light to produce a blue illumination for a desired object to thereby produce a desired effect. FIG. 7B illustrates use of a green colored light to produce a green illumination for a desired object and thereby produce a desired effect. FIG. 7C illustrates use of a red colored light to produce a red illumination for a desired object and thereby produce a desired effect.

Figure 8C:
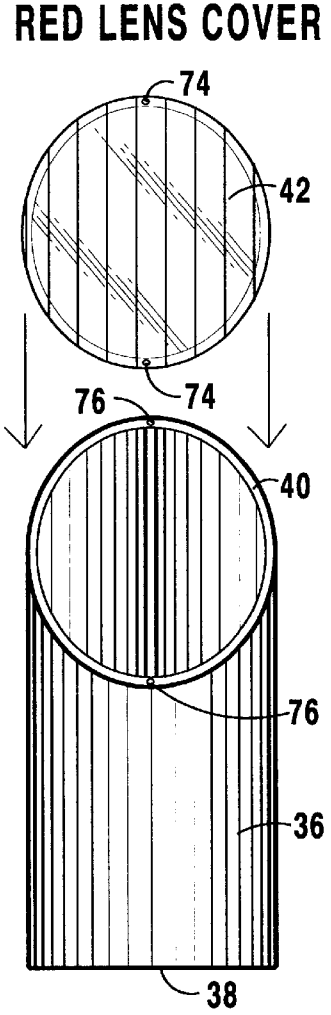
FIG. 8C is a side exploded view of the outdoor durable well light of the present invention illustrating placement of a lens color of a third, red, color thereon.
Figure 8B:
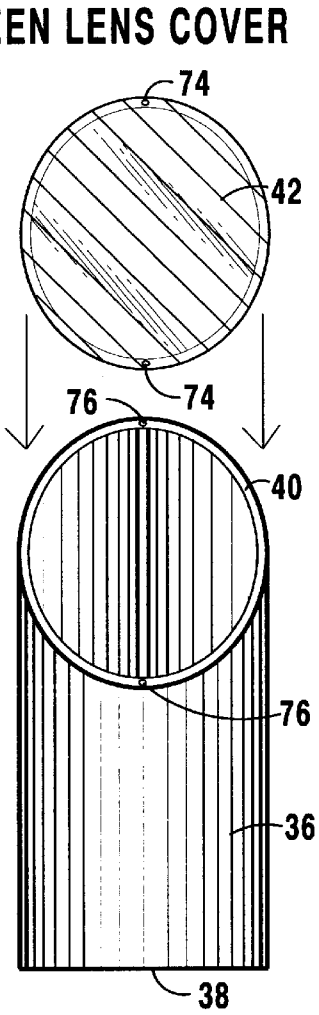
FIG. 8B is a side exploded view of the outdoor durable well light of the present invention illustrating placement of a lens color of a second, green, color thereon.
Figure 8A:
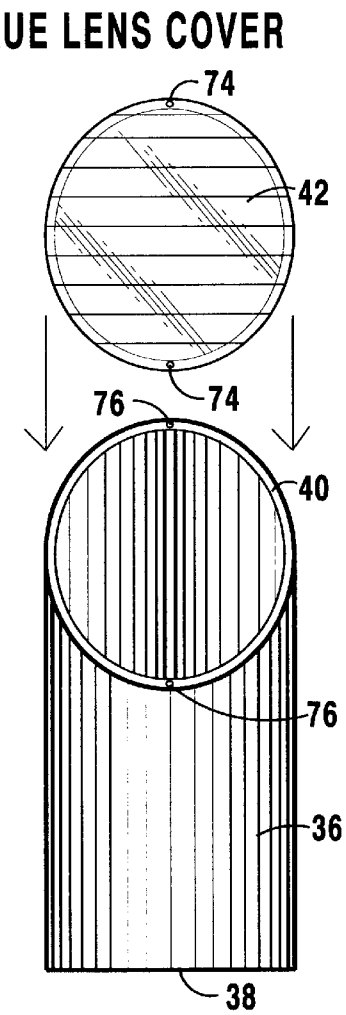
FIG. 8A is a side exploded view of the outdoor durable well light of the present invention illustrating placement of a lens color of a first, blue, color thereon.

FIGS. 8A, 8B and 8C illustrate the use of different colored covers to thereby change the tint of the produced light to a desired color. FIG. 8A illustrates use of a blue colored cover to produce a blue illumination for a desired object to thereby produce a desired effect. FIG. 8B illustrates use of a green colored cover to produce a green illumination for a desired object and thereby produce a desired effect. FIG. 8C illustrates use of a red colored cover to produce a red illumination for a desired object and thereby produce a desired effect.

Figure 9:
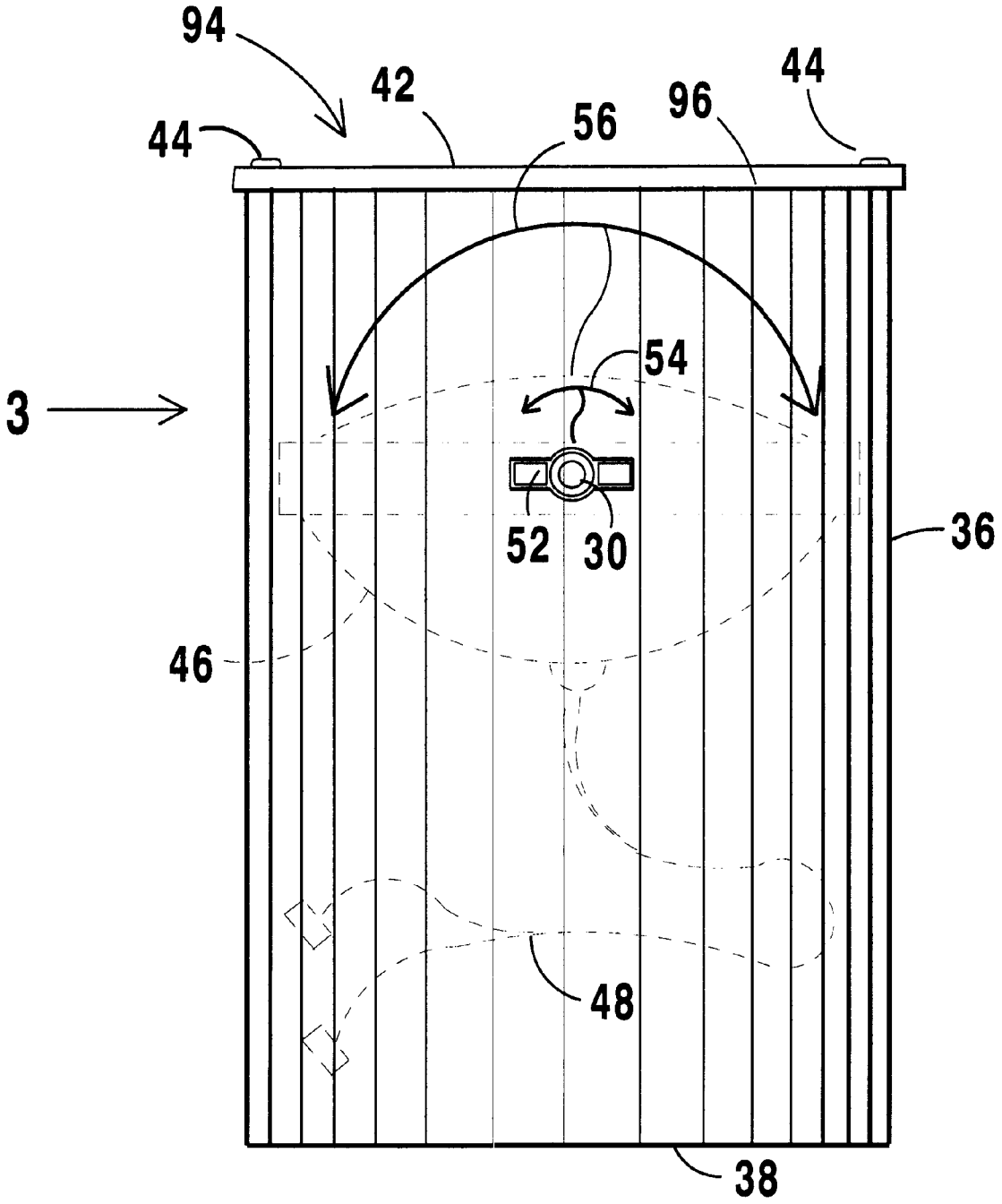
FIG. 9 is a side view of the outdoor durable well light of the present invention including a top side extending parallel to a flat surface on which the light is placed.

A side view of the well light 94 including a flat top side 96 extending parallel to the bottom side 38 is illustrated in FIG. 9 with the internal components shown in dashed lines. This embodiment is identical to that shown in FIGS. 1–8C however the top side 96 extends parallel to the surface on which the light is to be placed and therefor identical reference numbers are used to identify similar elements. As can be seen from this figure, the well light 94 includes a cylindrical housing 36 having a flat bottom side 38 for positioning the well light 94 on the ground 16 and the top side 96 extends parallel to the flat bottom side 38. A lens cover 42 is removably connected to the top side 96 by securing pins 44. A light 46 is pivotally connected within the cylindrical housing 36 and includes a power cord 48 extending therefrom for connection to an electrical supply. The light 46 is substantially cylindrical in shape and has a circumference slightly less than an inner diameter of the housing 36. The adjusting device 30 extends through a side wall 50 of the cylindrical housing 36 for connecting with the light 46. The adjusting device 30 includes a knob 52 which may be pivoted about a central axis extending therethrough as indicated by the arrow labeled 54. As the light 46 is pivotally connected to the cylindrical housing 36 and connected to the adjusting device 30, it is caused to pivot with the knob 52 as indicated by the arrow labeled 56.

Figure 10:
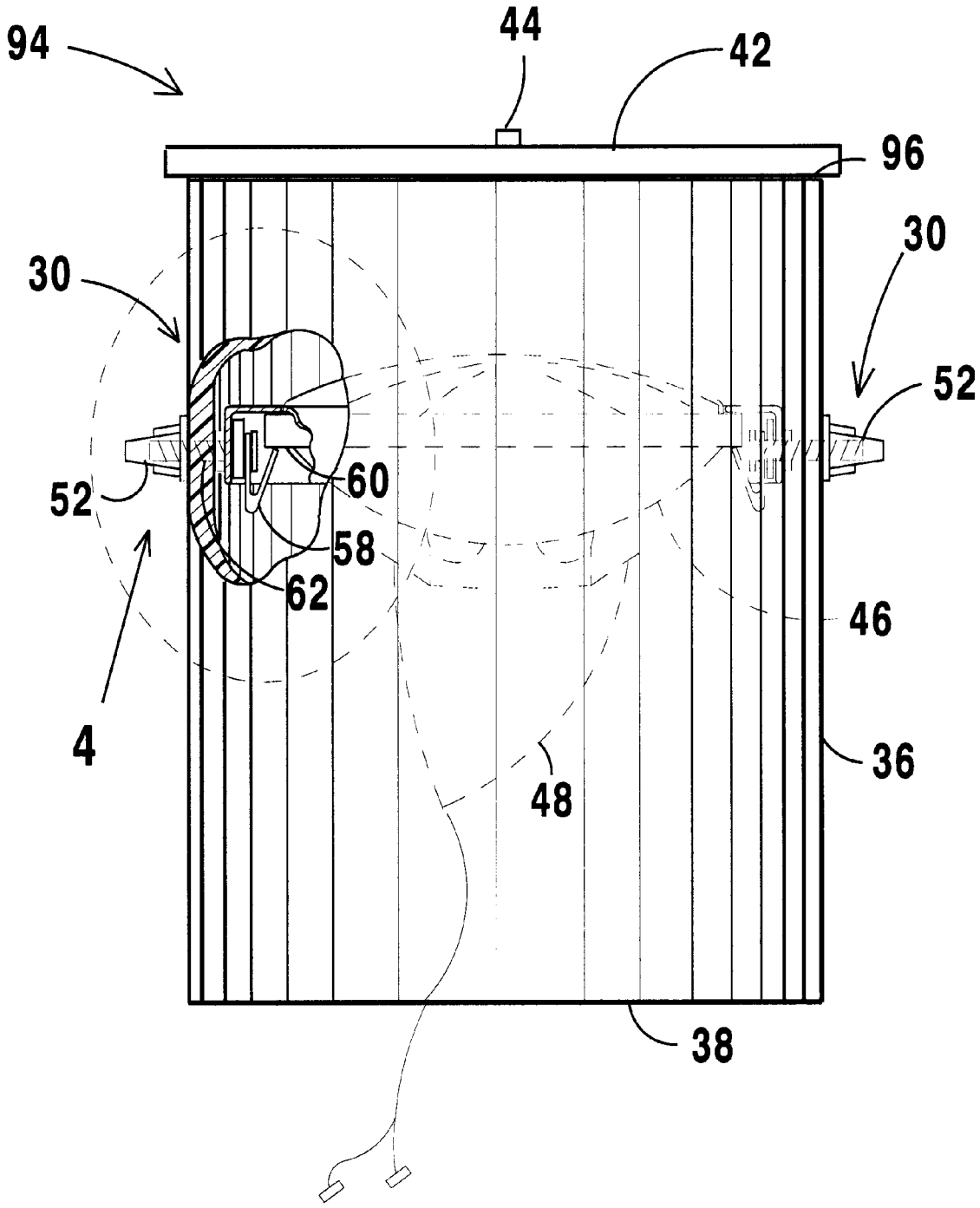
FIG. 10 is a front view with parts cut away of the outdoor durable well light of the present invention including the flat top side as shown in FIG. 9.

A front view of the well light 94 including the flat top side 96 is illustrated in FIG. 10. Again the elements contained within the cylindrical housing 36 are illustrated in dashed lines. A portion of the cylindrical housing 36 is cut away to illustrate the adjusting device 30 and its connection to the light 46. The adjusting device 30 includes knobs 52 on opposing sides of the cylindrical housing 36. Each of the knobs 52 extend through the cylindrical housing 36 and connect with the light 46. A ring 60 is positioned over the light 46 and extends past the edge of the light 46. A clip 58 is connected on either side of the ring 60 and a screw 62 extends through each respective clip 58 engaging a respective one of the knobs 52. Thus, when either or both of the knobs 52 are turned, the screws 62 are also caused to turn. The turning of the screws 62 cause the clips 58 and thus the ring 60 to pivot. As the ring 60 pivots, the light 46 is also caused to pivot. The pivoting of the light 46 causes the angle at which light is projected therefrom to change thus affect the lighting of the landscape 12. The direction of the projected light is thus adjusted to highlight a desired item or area.

The light 46 is set within the ring 60 and held by the clips 58 which are attached to the skirt 61 of the ring 60 by respective screws 62 which extend through the exterior wall of the housing 36 and are engaged by respective ones of the knobs 52. The clips 58 release the light 46 from its secured position when the screws 62 are released in order to replace the light 46.

The outdoor durable well light 94 illustrated in FIGS. 9 and 10 has a height which will cause the light to extend up from the surface on which it is placed a negligible amount. Thus, when positioned on a lawn to highlight certain areas or structures on the lawn, the light 94 will not need to be moved when mowing the lawn as a lawn mower will be able to readily pass thereover without any difficulty. Thus the light 94 will not create an obstruction to the lawnmower. Such a light would be typically used to light trees in a yard.

The operation of the outdoor durable well light 10 will now be described with reference to the figures. In operation, the outdoor durable well light 10 is first assembled by placing the desired color light within the ring 60 and securing the light 46 and ring within the housing 36 by placing the clips 58 within the pool and the screws 62 extending through the clips and skirt 61. The screws 62 are also caused to extend through the housing 36 and engage respective knobs 52. The desired color cover 42 is then selected and secured to the top side 40 of the housing 36 using the securing pins 44. The well light 10 is now ready for use.

The user will now select a desired location for the well light 10 and a desired object to be illuminated thereby. The well light 10 will be positioned in the desired location and adjacent the object and the power cord 48 will be connected to a supply of electricity. The well light 10 will now be turned on to produce an illumination. The user will now pivot or turn the knobs 52 causing the angle at which the light is projected to change until the desired angle and illumination is obtained. The object and area desired to be illuminated are now illuminated to a desired extent to thereby enhance the landscape on which it is positioned.

If desired the user may position additional well lights 10 around the landscape to illuminate additional objects and thereby further enhance the landscape during nighttime hours. The well lights 10 may be left in their position to illuminate the desired area at all times. The user may adjust the angle of projection of the light at any time desired by turning the knobs 52. The use may also change the color of the light as desired by either replacing the light with a different color light or changing the cover 42 to a different color cover 42.

When a light burns out is easily replaced. In order to change the light 46 the cover is removed by releasing the securing pins and then the screws are removed from their position extending through the housing 36. The light is then removed and replaced with a new light.

The housing 36 is made from a substantially inert material providing maintenance free outdoor lighting and is shaped to provide a directional path for the light beam. Extending through the wall of the housing there is a small aperture substantially covered by an elastomeric ring for providing a weatherproof seal and therethrough passing an electric cord 48. The electrical cord includes a connector located on a distal end thereof for connection to an electrical raceway or electrical outlet. The electrical cord 48 also includes an electrical connection for attaching an electric light bulb at the opposing end.

From the above description it can be seen that the outdoor durable well light of the present invention is able to overcome the shortcomings of prior art devices by providing an outdoor durable well light which is able to provide adequate lighting to a desired area and also highlight desired areas of a landscape. The outdoor durable well light includes easily manipulated controls for adjusting the azimuth of the light beam produced and thereby controlling the illumination of the desired area whereby a lens cover of any desired cover may be positioned to cover the light beam produced and thereby control the color tint of the produced light. Furthermore, the outdoor durable well light of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A well light for illuminating an area, said well light comprising:

a) cylindrical housing having an open top side;

b) means for producing a light positioned within said housing and projecting said light through said top side; and c) means for pivoting said means for producing to thereby change an angle of projection of said light produced and thereby illuminate a desired object to a desired intensity level, said means for pivoting including:

i) a knob positioned on a side of said housing opposite said means for producing;

ii) a ring extending around a top side of said means for producing; and iii) means for connecting said knob to said ring whereby when said knob is turned, said ring and said means for producing are caused to turn therewith, wherein said ring includes a skirt depending therfrom forming a pool between said skirt and said means for producing, said means for connecting includes a clip positioned within said pool for engaging said means for producing and a screw extending through said clip, said skirt and said housing for engaging said knob.

2. The well light as recited in claim 1, wherein said top side extends at an angle to a surface on which said light is positioned.

3. The well light as recited in claim 1, wherein said top side extends parallel to a surface on which said light is positioned.

4. The well light as recited in claim 1, wherein said means for producing is a light bulb.

5. The well light as recited in claim 4, wherein said light bulb is able to produce light of a desired color.

6. The well light as recited in claim 1, further comprising a cover releasably connected to said top side of said housing.

7. The well light as recited in claim 6, wherein said cover is a desired color to thereby tint the light produced by said means for producing.

8. The well light as recited in claim 7, wherein said color of said cover is blue.

9. The well light as recited in claim 7, wherein said color of said cover is green.

10. The well light as recited in claim 7, wherein said color of said cover is red.

11. A system for illuminating an area including a plurality of well lights, each of said plurality of well lights illuminating a desired portion of the area, each of said plurality of well lights comprising:

a) cylindrical housing having an open top side, said top side having a diagonal slant;

b) means for producing a light positioned within said housing and projecting said light through said diagonal top side; and c) means for pivoting said means for producing to thereby change an angle of projection of said light produced and thereby illuminate a desired object to a desired intensity level, said means for pivoting of each of said plurality of well lights include:

i) a knob positioned on a side of said housing opposite said means for producing;

ii) a ring extending around a top side of said means for producing; and iii) means for connecting said knob to said ring whereby when said knob is turned, said ring and said means for producing are caused to turn therewith, wherein said ring of each of said plurality of well lights includes a skirt depending therefrom forming a pool between said skirt and said means for producing and said means for connecting of each of said plurality of well lights includes a clip positioned within said pool for engaging said means for producing and a screw extending through said clip, said skirt and said housing for engaging said knob.

12. The system as recited in claim 11, wherein said means for producing of each of said plurality of well lights is a light bulb.

13. The system as recited in claim 12, wherein said light bulb of each of said plurality of well lights is able to produce light of a desired color.

14. The system as recited in claim 11, wherein at least one of said plurality of well lights further comprises a cover releasably connected to said top side of said housing.

15. The system as recited in claim 14, wherein said cover of said at least one of said plurality of well lights is a desired color to thereby tint the light produced by said means for producing.

16. The well light as recited in claim 15, wherein said color of said cover is blue.

17. The well light as recited in claim 15, wherein said color of said cover is green.

18. The well light as recited in claim 15, wherein said color of said cover is red.

* * * * *